United States Patent [19]

Micheli

[11] Patent Number: 4,812,333

[45] Date of Patent: Mar. 14, 1989

[54] SULFIDE THIN FILM FORMED FROM STABILIZED METALLO-ORGANIC SOLUTION

[75] Inventor: Adolph L. Micheli, Mt. Clemens, Mich.

[73] Assignee: General Motors Corporation, Detroit, Mich.

[21] Appl. No.: 189,081

[22] Filed: May 2, 1988

[51] Int. Cl.[4] ..... B05D 3/02

[52] U.S. Cl. ..... 427/226; 106/287.18; 106/287.32; 556/5; 427/126.1; 427/66

[58] Field of Search ..... 427/226, 66, 126.1; 106/287.18, 287.32; 556/5

[56] References Cited

FOREIGN PATENT DOCUMENTS 62-146276 6/1987 Japan .

*Primary Examiner*—Sam Silverberg

*Attorney, Agent, or Firm*—Douglas D. Fekete

[57] ABSTRACT

A metal sulfide thin film, such as a zinc sulfide thin film, is formed by thermal decomposition of a metal mercaptide or other suitable metallo-organic compound having a metal-to-sulfur bond. To produce the film, the metallo-organic compound is applied to a substrate in a solution that also contains a sulfur to facilitate dissolution of the compound and enhance stability of the solution. It is also found that sulfur addition reduces carbon contamination of the product sulfide thin film.

9 Claims, No Drawings

SULFIDE THIN FILM FORMED FROM STABILIZED METALLO-ORGANIC SOLUTION

BACKGROUND OF THE INVENTION

This invention relates to a metal sulfide thin film, such as a zinc sulfide thin film, formed by thermal decomposition of a metallo-organic compound characterized by a metal-to-sulfur bond. More particularly, this invention relates to a sulfur-stabilized metallo-organic solution that is useful in forming the metal sulfide thin film.

In the electronics industry, it is known to employ elements that comprise a thin film of a metal sulfide compound. For example, zinc sulfide thin film elements are employed in electroluminescent devices. Common methods for forming sulfide thin films employ vacuum techniques, such as vacuum evaporation or sputtering, that are relatively expensive and difficult to control, particularly in mass production operations.

Metal oxide thin film elements have been formed by thermal decomposition of metallo-organic compounds having a metal-to-oxygen bond. It is also known that metallo-organic compounds having metal-to-sulfur bonds, such as metal mercaptides, similarly decompose to produce metal sulfides. However, metallo-organic deposition of sulfide thin films has heretofore been hindered because of the difficulty of forming a stable solution of the metallo-organic compound in a suitable vaporizable solvent, particularly at concentrations sufficient to produce films of desired thickness. Furthermore, it is necessary to decompose such metal-sulfur organic compounds in an inert atmosphere to avoid oxidation. However, inert atmosphere decomposition also produces carbon as a result of pyrolysis of the organic ligand, which contaminates the sulfide film.

It is an object of this invention to provide a stabilized, concentrated solution of a sulfur-bonded metallo-organic compound, such as a metal mercaptide, in a vaporizable solvent, which solution may be used to apply the compound onto a substrate for thermal decomposition to form a sulfide thin film.

It is also an object of this invention to provide an improved method for forming by thermal decomposition of a sulfur-bonded metallo-organic compound a metal sulfide thin film element having reduced carbon contamination, which method employs a stabilized, concentrated solution to apply the metallo-organic compound onto a substrate. The solution includes an agent that not only increases solubility of the metal-organic compound and enhances the stability of the resulting solution, but also reduces carbon contamination of the product metal sulfide thin film.

SUMMARY OF THE INVENTION

In accordance with a preferred embodiment of this invention, these and other objects are obtained by an addition of elemental sulfur to a solution of zinc mercaptide in pyridine. In the absence of a sulfur addition, it is found that zinc mercaptide has limited solubility in pyridine and further that the zinc mercaptide that does dissolve tends to separate from the solution upon standing. However, sulfur added in accordance with this invention increases the solubility of zinc mercaptide in pyridine and forms a stable solution that resists separation even over an extended time up to several months. While sulfur additions up to five percent of the mercaptide weight have been tested, additions up to one percent of mercaptide weight are generally adequate to produce stable, concentrated solutions. In a preferred embodiment, a sulfur addition of about 0.5 percent of mercaptide weight produced a stable pyridine solution containing greater than 39 weight percent zinc mercaptide compound. As used herein, sulfur concentration is reported in weight percent based upon the weight of mercaptide, as opposed to the total solution weight used to report mercaptide concentration.

To produce a zinc sulfide thin film element, the sulfur-stabilized zinc mercaptide solution is applied onto a suitable substrate, preferably while spinning the substrate to distribute the solution. Thereafter, the pyridine, which has a boiling point of about 115.5° C., evaporates at ambient temperature to produce a dried zinc mercaptide layer that comprises the added elemental sulfur. The dried layer is heated at a temperature sufficient to decompose the zinc mercaptide and produce zinc sulfide. To avoid oxidation that would otherwise produce zinc oxide instead of the desired sulfide, this decomposition is carried out in an inert atmosphere. Such conditions tend to produce cracking of the organic ligand of the mercaptide compound, resulting in the formation of unwanted carbon. However, it is found that the sulfur addition reduces the carbon content in the product zinc sulfide film. It is believed that the added sulfur may react with nascent carbon to produce a volatile carbon sulfur compound. Residual unreacted sulfur vaporizes at the pyrolysis temperature. Thus, the method of this invention produces a zinc sulfide film that is substantially uncontaminated by either carbon or free sulfur. Furthermore, the use of the sulfur-stabilized solution in accordance with this invention permits a more concentrated solution to be applied, thereby depositing a greater amount of zinc compound per area, which in turn produces a thicker zinc sulfide film. By adjusting the solution concentration and application conditions, it is thus possible to control the amount of zinc applied to a surface to obtain a film having a desired thickness for an intended use.

DETAILED DESCRIPTION OF THE INVENTION

In accordance with a preferred embodiment, a zinc sulfide thin film is formed on an inert substrate by thermal decomposition of zinc dodecyl mercaptide applied in a sulfur-containing pyridine solution. About 65 grams zinc dodecyl mercaptide and 0.3 gram of powdered sublimed sulfur were added to 100 milliliters pyridine and stirred to produce a homogenous solution. The solution was found to remain homogenous, even after sitting several months. In contrast, comparable amounts of the zinc mercaptide do not dissolve in pyridine without the sulfur addition.

The pyridine solution was applied to a borosilicon glass substrate. The substrate was spun at about 2000 revolutions per minute. Using an eyedropper, the solution was applied near the axis of rotation and distributed by the spinning action. The resulting layer was dried in air. The substrate bearing the dried layer was heated in an argon atmosphere to a temperature of about 600° C. The substrate was heated at a rate of 50° C. per minute to 600° C. and held at that temperature for about 10 minutes. The resulting thin film was found to be formed substantially of cubic zinc sulfide, ZnS. The film had a thickness of about 1500 Angstroms. Analysis indicated low levels of carbon contamination, particularly when compared to films formed similarly but without the sulfur addition.

Therefore, in the described embodiment, a high purity zinc sulfide thin film was formed by thermal decomposition of zinc mercaptide compound applied in a sulfur-stabilized pyridine solution. The sulfur addition to the pyridine solution was found to increase the solubility of the zinc mercaptide in the pyridine, improve the stability of the resulting solution and also reduce carbon contamination of the product film.

While this invention has been described in terms of a particular zinc mercaptide compound, it may be suitably employed to form stabilized solutions of other suitable metallo-organic compounds containing zinc or other metals. Suitable metallo-organic compounds include any organic compound comprising, in addition to a metal, a sulfur forming part of the organic ligand and bonded to the metal, which compound thermally decomposes under nonoxidative conditions to form a metal sulfide. Examples of suitable classes of metallo-organic compounds include mercaptides and thiocarboxylates. In addition to zinc, this invention may be employed to form sulfide films of cadmium, copper, lead or other metal by decomposing a suitable metallo-organic compound containing the desired metal, which suitable compound is applied in a sulfur-stabilized solution. In particular, cadmium sulfide thin films are useful in the electronics industry and may be suitably formed by applying a sulfur-stabilized mercaptide solution, followed by thermal decomposition of the mercaptide. Furthermore, a compound of a second metal may be dissolved in the solution to produce a doped sulfide film. For example, manganese chloride may be dissolved into a sulfur-stabilized pyridine solution containing zinc mercaptide such as in the described embodiment to produce a manganese doped zinc sulfide thin film.

In the described embodiment, the preferred solvent was pyridine. However, carbon disulfide or other suitable solvent in which the metallo-organic compound and the sulfur are mutually soluble may be employed. Although pyridine readily evaporates at ambient temperature, the applied solution may be heated to vaporize the solvent and form a deposit comprising the metallo-organic compound and sulfur, prior to further heating to form the desired sulfide film.

Sulfur having a fine particle size, such as a powdered sublimed sulfur in the described embodiment, is preferred to facilitate dissolution. For pyridine solutions containing zinc dodecyl mercaptide, additions of sulfur in amounts up to five percent of the mercaptide weight have been found to successfully produce concentrated, stable solutions and suitable zinc sulfide thin films. Although excess sulfur readily vaporizes at the elevated temperature used for mercaptide decomposition, it is found that increased sulfur additions tend to produce striated films due to formation of a transient sulfur liquid phase in a quantity sufficient to disrupt the film. Thus, it is desired to minimize the sulfur addition. In general, sulfur additions up to one percent are effective to produce a stabilized solution and reduce carbon contamination, and thus are preferred. Optimum sulfur additions are believed to be between about 0.3 and 1.0 percent based upon mercaptide weight.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A method for producing a metal sulfide thin film comprising applying onto a substrate a stabilized solution comprising a thermally decomposable metallo-organic compound and elemental sulfur dissolved in a vaporizable solvent, said metallo-organic compound selected from the group consisting of mercaptides and thiocarboxylates evaporating the solvent to a deposit comprising the metallo-organic compound and the sulfur, and heating the deposit while exposed to an inert atmosphere to a temperature sufficient to decompose the metallo-organic compound to form a metal sulfide thin film.

2. A method for forming a metal sulfide thin film on a substrate comprising applying onto the substrate a solution comprising a thermally decomposable metal mercaptide compound and elemental sulfur dissolved in pyridine solvent, said sulfur being added in an amount effective to increase solubility of the metal mercaptide and form a stable solution, evaporating the solvent to form a deposit comprising the metal mercaptide and the sulfur, and heating the deposit while exposed to a nonoxidizing atmosphere to a temperature sufficient to decompose the metal mercaptide compound to form a metal sulfide thin film, whereupon sulfur reacts with carbon derived by said thermal decomposition to form vaporizable carbon sulfur compounds, thereby reducing carbon contamination of the metal sulfide thin film.

3. The method of claim 2 wherein the metal mercaptide compound is a zinc mercaptide compound and said heating decomposes the zinc mercaptide compound to form a zinc sulfide thin film.

4. The method of claim 2 wherein the solution contains sulfur in an amount up to about one percent by weight of the metal mercaptide compound.

5. A stable solution comprising a metallo-organic compound dissolved in a solvent, said metallo-organic compound selected from the group consisting of mercaptides and thiocarboxylates comprising elemental sulfur dissolved in said solvent in an amount effective to increase solubility of said metallo-organic compound in said solution and to form a stable solution.

6. A stable solution comprising a metal mercaptide compound dissolved in pyridine solvent and further comprising elemental sulfur dissolved in said pyridine solvent in an amount effective to increase solubility of said metal mercaptide compound in said solution and to form a stable solution.

7. The solution of claim 6 wherein the metal mercaptide compound is a zinc mercaptide compound.

8. The solution of claim 6 wherein the solution comprises sulfur in an amount less than one percent by weight of the dissolved metal mercaptide compound.

9. The solution of claim 6 wherein the solution comprises sulfur in an amount between about 0.3 and 1.0 percent by weight of the dissolved metal mercaptide compound.

* * * * *